US006227697B1

(12) United States Patent
Stahl

(10) Patent No.: US 6,227,697 B1
(45) Date of Patent: May 8, 2001

(54) MIXER INCLUDING GEARING FOR MULTIPLE MIXING TOOLS HAVING RESILIENT MOUNTINGS

(76) Inventor: Walter Stahl, Hauptstrasse 29, D-67361 Freisbach (DE)

( * ) Notice: Subject to any disclaimer, the term of this patent is extended or adjusted under 35 U.S.C. 154(b) by 0 days.

(21) Appl. No.: 09/275,779

(22) Filed: Mar. 25, 1999

(30) Foreign Application Priority Data

Mar. 25, 1998 (DE) ..... 298 05 360 U

(51) Int. Cl.[7] ..... B01F 7/30
(52) U.S. Cl. ..... 366/288; 366/65
(58) Field of Search ..... 366/65–67, 96–97, 366/102–104, 287–288, 292, 297–300

(56) References Cited

U.S. PATENT DOCUMENTS

| | | | | |
|---|---|---|---|---|
| 364,622 | * | 6/1887 | Zies . | |
| 1,790,928 | * | 2/1931 | Larsh . | |
| 2,203,135 | * | 6/1940 | Farrington . | |
| 3,224,744 | * | 12/1965 | Broomall . | |
| 4,380,398 | * | 4/1983 | Burgess | 366/288 |
| 4,453,831 | * | 6/1984 | Mahon | 366/66 |
| 4,697,929 | * | 10/1987 | Muller | 366/97 |
| 4,704,035 | * | 11/1987 | Kowalczyk | 366/288 |
| 4,786,184 | * | 11/1988 | Berezkina et al. | 366/288 |
| 5,302,020 | * | 4/1994 | Kruse | 366/288 |

FOREIGN PATENT DOCUMENTS

| | | | | |
|---|---|---|---|---|
| 801 619 | | 2/1951 | (DE) . | |
| 1 557 252 | | 4/1970 | (DE) . | |
| 2 115 428 | | 10/1971 | (DE) . | |
| 2 129 549 | | 2/1972 | (DE) . | |
| 2 051 691 | | 4/1972 | (DE) . | |
| 31 13 141 | | 4/1982 | (DE) . | |
| 91 04 038 | | 8/1991 | (DE) . | |
| 0 565 894 | | 10/1993 | (EP) . | |
| 0 566 102 | | 10/1993 | (EP) . | |
| 42 12 937 | | 10/1993 | (DE) . | |
| 4212937 C2 | | 10/1993 | (DE) . | |
| 568776 | * | 4/1924 | (FR) | 366/288 |
| 2 680 887 | | 3/1993 | (FR) . | |

* cited by examiner

*Primary Examiner*—Charles E. Cooley
(74) *Attorney, Agent, or Firm*—Evenson, McKeown, Edwards & Lenahan, P.L.L.C.

(57) ABSTRACT

A mixer including a mixing vat (2), a mixer rotor (8) rotatable by a drive motor (6) around an essentially vertical axis of rotation (10) and a first mixing tool (14) mounted on the mixer rotor (8) so as to rotate around a first axis. Additionally located on the mixer rotor (8) is at least one further mixing tool (24), the mixing tools extending from above down into the mixing vat (2) or into the mixed substance. In order to optimize thorough mixing of the substances being mixed with minimum expense for construction, the mixer rotor (8) is provided with a set of gears (22) by which the first mixing tool (14) and a second rotatable mixing tool (18) are coupled such that the rotational speed of the second mixing tool (18) is greater than the rotational speed of the first mixing tool (14) by a predetermined factor.

12 Claims, 2 Drawing Sheets

MIXER INCLUDING GEARING FOR MULTIPLE MIXING TOOLS HAVING RESILIENT MOUNTINGS

BACKGROUND OF THE INVENTION

The invention relates to a mixer comprising a mixing vat, a mixer rotor rotatable around an essentially vertical axis of rotation by means of a motor, a first mixing tool mounted on the mixer rotor which rotates around a first axis, and an additional mixing tool mounted the mixer rotor, wherein the mixing tools extend down from above into the mixing vat.

A mixer of this type is known from German Patent No. DE 4,212,937, which is constructed as a pan mixer and which has a rotor that is operable by means of a drive motor connected to it by a set of gears. The rotor contains several mixing tools which extend down from above into the mixing vat. At least one mixing tool of the mixer rotor is rotated around an axis of the mixing tool by means of an additional set of gears located on the mixer rotor. A different mixing tool, one for instance designed as a paddle, is mounted on the mixer rotor, advantageously by means of resilient mounts, in such a way as to only turn on the rotational axis of the mixer rotor in the mixing vat.

SUMMARY OF THE INVENTION

It is an object of the invention to provide an improved mixer.

Another object of the invention is to provide a mixer which can be constructed at low cost and yet optimize the thorough mixing of the substances being mixed.

A further object of the invention is to provide a mixer which assures both economical operation and quick, even mixing of the mixed substance.

It is also an object of the invention to provide a mixer which is very safe to operate and easy to access and service.

These and other objects are achieved in accordance with the present invention by providing a mixer comprising a mixing vat, a mixer rotor rotatable by means of a drive motor around an essentially vertical axis of rotation, a first mixing tool mounted on the mixer rotor which rotates around a first axis, and at least one additional mixing tool mounted on the mixing rotor, wherein the mixing tools extend from above down into the mixing vat, the mixer rotor contains a set of gears by which the first mixing tool and a second rotatable mixing tool are coupled so that the rotational speed of the second mixing tool is greater than the rotational speed of the first mixing tool by a prescribed factor.

The mixer according to the invention is distinguished from others through its functional construction and assures a quick and even mixing of the mixed substance. The mixer contains two mixing tools, which turn about their axes of rotation with different rates of rotation and are linked by means of a common set of gears. Thus, one of the mixing tools can be designed as a mixing star while the other mixing tool is designed as a swirler, the speed of which is greater by a predetermined factor than that of the aforementioned first mixing tool or mixing star. A motor for driving the mixer rotor, in particular an electric motor, is provided, and the set of gears of the two rotatable mixing tools which is located on the mixer rotor is also powered by this motor. The set of gears is optimally located in the middle of the mixer rotor so as to leave hollow spaces on both sides, and in at least one of these hollow spaces is located the preferably resilient mount for a mixing tool which is rotatable only together with the mixer rotor around its axis of rotation. The mixer rotor has a housing which is essentially rotationally symmetrical and/or cylindrical, which housing assures an encapsulation or enclosure of the set of gears located within it as well as of the mount, particularly a resilient arm mount, for the additional mixing tool. Penetration of mixed substance, dirt or the like into the interior of the mixer rotor is thus avoided in a particularly advantageous manner. The hollow space containing the preferably resilient mount of the additional mixing tool is easily accessible, if necessary, by opening the housing, and thus it is possible to carry out maintenance and servicing measures with ease. Preferably, the mixer rotor is rotatably mounted on the underside of a support frame preferably by means of a large roller bearing, while the drive motor is disposed on the upper side of the mounting frame, and a motor shaft extends from the drive motor through the mounting frame down to the mixer rotor.

Refinements and specific embodiments of the invention are described in the remainder of the specification.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
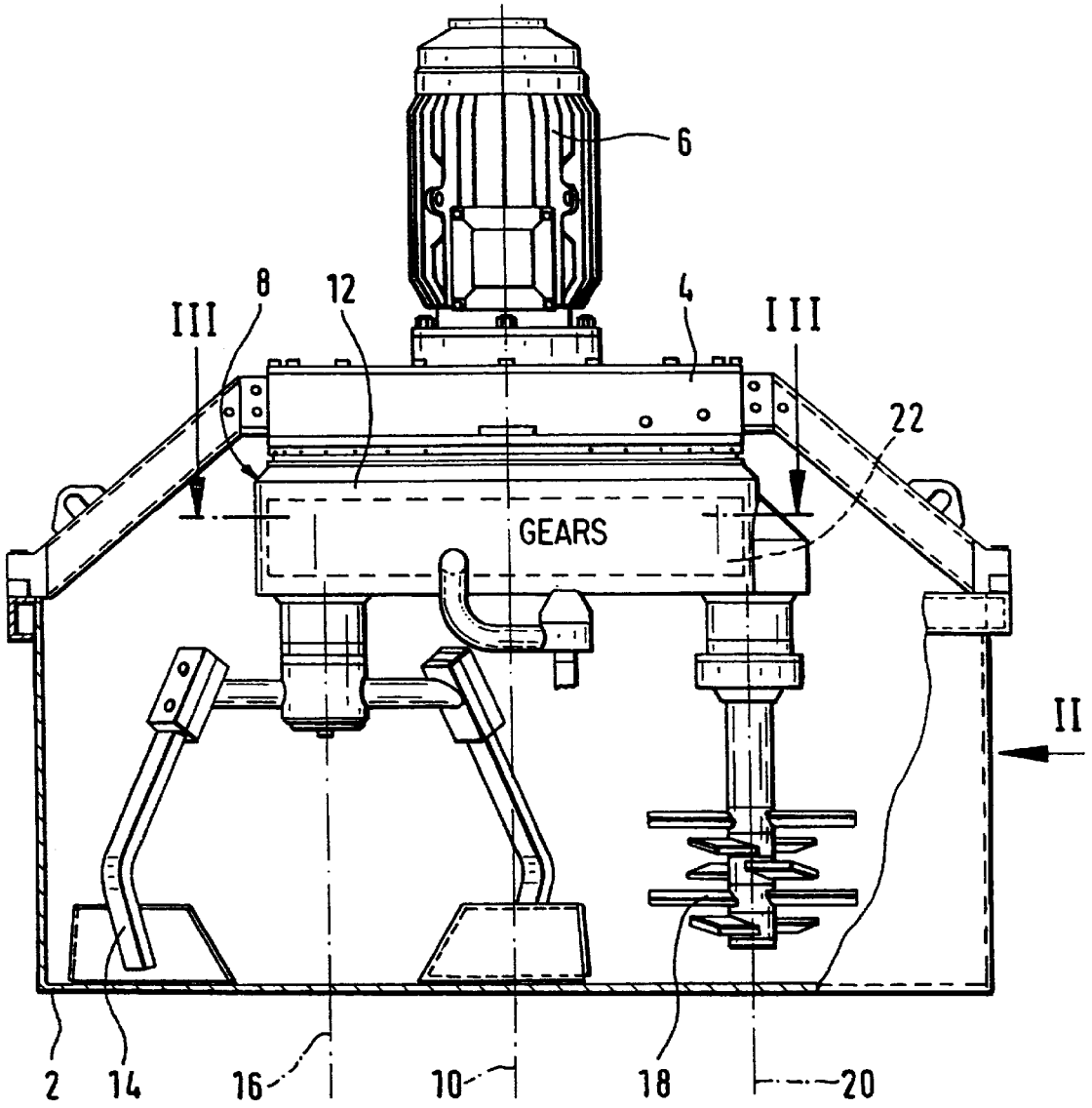
FIG. 1 is a side view of the mixer in which the mixing vat is partially shown in cross section.

FIG. 1 shows a mixer with a mixing vat 2, above which is mounted a support frame 4. On the upper side of the support frame 4, a drive motor 6 is provided, particularly an electric motor, and on the underside of the support frame 4 a mixer rotor 8 is attached by means of a large roller bearing not further depicted here. The mixer rotor 8, which is rotatable by means of the drive motor 6, is designed to be essentially rotationally symmetrical with respect to the vertical axis of rotation and includes a housing 12 for the purpose of protectively enclosing the components located within which are described in further detail hereinafter. In this manner, the set of gears 22 located within the encapsulated mixer rotor 8 is protected from contaminating elements and the intrusion of foreign bodies or portions of the mixed substance. In addition, the housing 12 effectively prevents contamination of the mixed substance, particularly by grease or gear lubricant oil.

The mixer rotor 8 has on its underside a first mixing tool 14, which is preferably designed as a mixing star and is mounted in the mixer rotor 8 so as to be rotatable around a first axis of rotation 16. When the drive motor 6 is switched on, the mixer rotor rotates on its axis 10, and simultaneously the first mixing tool 14 turns on the first axis 16 due to a geared linkage. Diametrically opposite the first mixing tool 14, the mixer rotor 8 has a second mixing tool 18 which can be rotated around a second axis 20. The second mixing tool 18 is preferably designed as a swirler and turns with a prescribed rotational speed which, according to the invention, is greater than the speed of the first mixing tool by a predetermined factor. The two mixing tools 14, 18 are coupled by means of a set of gears 22 which are located with mixer rotor 8. The set of gears 22 is constructed in such a way that the rotational speed of the second mixing tool 18 is faster than that of the first mixing tool 14 by the predetermined factor which should preferably be between three and twenty and most advantageously on the order of six. For example, if the mixer rotor 8 rotates at a speed of 15 rpm, the speed of the first mixing tool 14 is 40 rpm, in accordance with the predetermined gear ratio. If in this preferred embodiment a gear ratio of 6 is established by means of the gears 22, the speed of the swirler or second mixing tool 18 would be 240 rpm.

Figure 2:
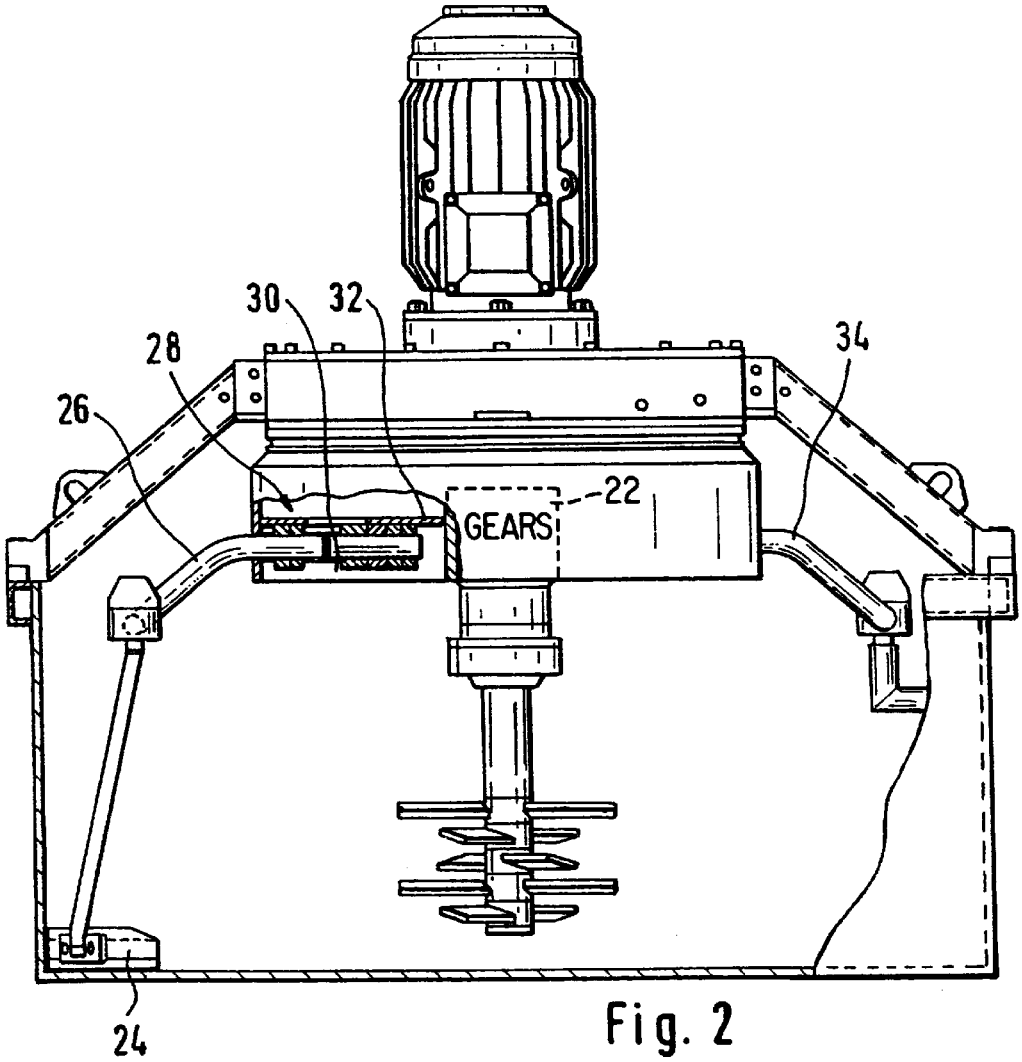
FIG. 2 is a side view in a direction turned 90° about a vertical axis with respect to FIG. 1.

FIG. 2 shows the mixer in a viewing direction II turned 90° with respect to FIG. 1. The mixer rotor 8 carries an additional mixing tool 24 which does not turn separately on a special axis, but turns exclusively along with the mixer rotor 8 on its axis of rotation 10. The additional mixing tool 24 is mounted on an arm 26 in a resilient mounting 28 in a hollow space 30 of the mixer rotor 8. The resilient mounting 28 is advantageously located on an intermediate base 32 of the mixer rotor 8. By removing the section of housing provided under the arm 26 or the resilient mounting 28, easy access and consequently easy assembly or disassembly are enabled. The hollow space 30 is provided radially to the side of the gears 22. The mixer rotor 8 or its housing is designed to be partially openable, so that the hollow space 30 and the resilient mounting 28 for the mixing arm 26 are accessible when necessary. Diametrically opposite the additional mixing tool 24, an additional fourth mixing tool 34 is disposed in a corresponding manner on the mixer rotor 8, namely by means of a resilient mounting in a corresponding hollow space of the mixer rotor 8.

Figure 3:
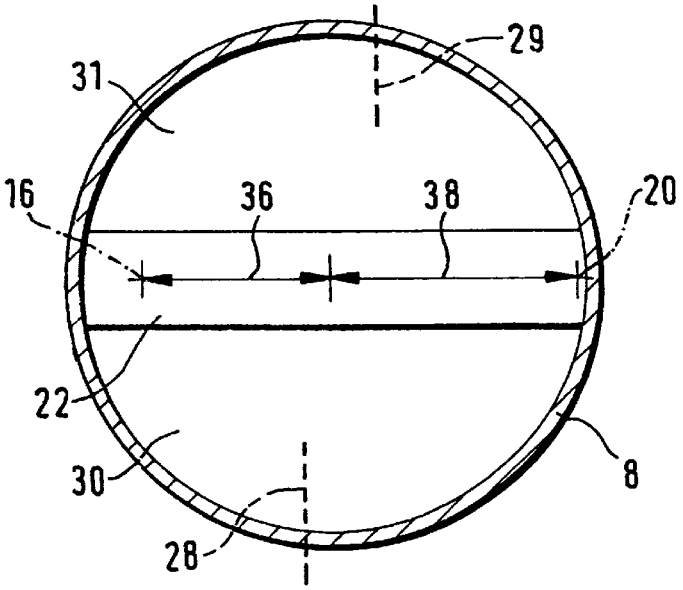
FIG. 3 is a schematic cross-section of the mixer rotor taken in a horizontal plane.

FIG. 3 schematically depicts a cross-section of the mixer rotor 8 taken in a horizontal plane, as seen in viewing direction III—III according to FIG. 1. The gears 22 extend over the middle region of the mixer rotor 8, through which the geared coupling of the first and second mixing tools is effected, which tools can rotate respectively on axes 16, 20. The set of gears 22 essentially extends radially over the total diameter of the mixer rotor 8. As can be seen, these mixing tools, or their axes 16, 20, lie diametrically opposed to each other, each at a given radial distance of 36 or respectively 38 from the vertical axis 10 of the mixer rotor 8. On both sides of the set of gears 22, the mixer rotor 8 has the aforementioned lateral hollow spaces 30, 31, for accommodating the resilient mountings 28, 29 of the additional mixing tools. This results in a symmetrical arrangement of the gears 22 in the center of the mixer rotor 8, and the hollow spaces 30, 31, which are essentially the same size, lie on both sides in a radially outward direction.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. A mixer comprising a mixing vat, a mixer rotor rotatable by means of a drive motor around an essentially vertical axis of rotation, a first mixing tool mounted on said mixer rotor which rotates around a first axis, and at least one additional mixing tool mounted on said mixer rotor, wherein said mixing tools extend from above down into the mixing vat, said mixer rotor containing a set of gears by which said first mixing tool and the at least one additional mixing tool are coupled so that the rotational speed of the second at least one additional mixing tool is greater than the rotational speed of the first mixing tool by a prescribed factor, and wherein said mixer rotor includes an enclosed housing in which the set of dears and at least one resilient mounting for a further additional mixing tool are located.

2. A mixer according to claim 1, wherein the rotational speed of the at least one additional mixing tool is greater than the rotational speed of the first mixing tool by a factor of 3 to 20.

3. A mixer according to claim 2, wherein the rotational speed of said second the at least one additional mixing tool is greater than the rotational speed of the first mixing tool by a factor of about 6.

4. A mixer according to claim 1, wherein said set of gears is arranged in a central region of said mixer rotor, and the respective rotational axes of the first mixing tool and the at least one additional mixing tool are arranged diametrically opposite each other on said mixer rotor.

5. A mixer according to claim 4, wherein the respective rotational axes of the first mixing tool and the at least one additional mixing tool are arranged in end regions of said set of gears.

6. A mixer according to claim 1, wherein the mixer rotor comprises at least one hollow space positioned laterally of said set of gears.

7. A mixer according to claim 1, wherein said first mixing tool is a mixing star.

8. A mixer according to claim 1, wherein the at least one additional mixing tool is a swirler.

9. A mixer comprising a mixing vat, a mixer rotor rotatable by means of a drive motor around an essentially vertical axis of rotation, a first mixing tool mounted on said mixer rotor which rotates around a first axis, and at least one additional mixing tool mounted on said mixer rotor, wherein said mixing tools extend from above down into the mixing vat, said mixer rotor containing a set of gears by which said first mixing tool and the at least one additional mixing tool are coupled so that the rotational speed of the at least one additional mixing tool is greater than the rotational speed of the first mixing tool by a prescribed factor. and wherein a hollow space is provided on either side of said set of gears, each of said hollow spaces containing a resilient mounting for a further additional mixing tool.

10. A mixer according to claim 9, wherein said hollow spaces are symmetrically arranged radially outwardly of said set of gears.

11. A mixer according to claim 9, wherein each of said resilient mountings is disposed on an intermediate base positioned laterally of said set of gears.

12. A mixer comprising a mixing vat, a mixer rotor rotatable by means of a drive motor around an essentially vertical axis of rotation, a first mixing tool mounted on said mixer rotor which rotates around a first axis, and at least one additional mixing tool mounted on said mixer rotor, wherein said mixing tools extend from above down into the mixing vat, said mixer rotor containing a set of gears by which said first mixing tool and the at least one additional mixing tool are coupled so that the rotational speed of the at least one additional mixing tool is greater than the rotational speed of the first mixing tool by a prescribed factor, and wherein said mixer rotor is located below a support frame and said mixer rotor includes an enclosed housing in which the set of gears and at least one resilient mounting for a further additional mixing tool are located.

* * * * *

UNITED STATES PATENT AND TRADEMARK OFFICE

CERTIFICATE OF CORRECTION

PATENT NO. : 6,227,697 B1
DATED : May 8, 2001
INVENTOR(S) : Walter Stahl

It is certified that error appears in the above-identified patent and that said Letters Patent is hereby corrected as shown below:

Column 4,
Line 3, please change "dears" to -- gears --.

Signed and Sealed this

Twenty-ninth Day of January, 2002

*Attest:*

*Attesting Officer*

JAMES E. ROGAN
*Director of the United States Patent and Trademark Office*